US009689543B1

(12) United States Patent
Haines

(10) Patent No.: US 9,689,543 B1
(45) Date of Patent: Jun. 27, 2017

(54) FERRO FLUID LAMP

(71) Applicant: Kyle Haines, Allentown, PA (US)

(72) Inventor: Kyle Haines, Allentown, PA (US)

( * ) Notice: Subject to any disclaimer, the term of this patent is extended or adjusted under 35 U.S.C. 154(b) by 44 days.

(21) Appl. No.: 15/005,728

(22) Filed: Jan. 25, 2016

Related U.S. Application Data

(60) Provisional application No. 62/114,172, filed on Feb. 10, 2015.

(51) Int. Cl.
*F21V 33/00* (2006.01)
*F21S 10/00* (2006.01)
*F21W 121/00* (2006.01)

(52) U.S. Cl.
CPC ..... *F21S 10/002* (2013.01); *F21W 2121/00* (2013.01)

(58) Field of Classification Search
CPC . F25D 27/00; F21W 2131/305; F21S 10/002; F21S 2121/00
USPC ..... 362/92, 562
See application file for complete search history.

(56) References Cited

U.S. PATENT DOCUMENTS 4,511,952 A * 4/1985 Vanbragt ..... F21S 13/00 362/159
6,241,359 B1 * 6/2001 Lin ..... F21S 10/002 362/101
7,478,914 B2 * 1/2009 Finkle ..... G09F 19/00 362/101
7,717,581 B2 * 5/2010 Lin ..... F21S 10/002 362/101
8,246,356 B2 * 8/2012 Vanderelli ..... G01R 33/10 434/276
8,681,423 B1 * 3/2014 Gibson ..... G02B 6/0035 349/196

* cited by examiner

*Primary Examiner* — Ahshik Kim
(74) *Attorney, Agent, or Firm* — Michael J. Feigin, Esq.; Cheryl R. Figlin, Esq.; Feigin & Fridman

(57) ABSTRACT

A novelty lamp, which includes a transparent or translucent container with a top surface and a bottom surface. The bottom surface of the container is mounted in a base member. Two substances are received in the container, one of which is ferro fluid. The ferro fluid has a higher relative density at room temperature and is immiscible with the other substance. Upon application of heat, which is supplied by a light bulb mounted within the base member, globules of the substance with the initially higher relative density become less dense, rise in the other substance and flow around the container. As the globules rise toward the top surface of the container they cool, become denser and drop back down toward the bottom surface of the container. Because the ferro fluid is a magnetic liquid, magnets can manipulate it, while it changes density and flows in the container.

20 Claims, 3 Drawing Sheets

FERRO FLUID LAMP

BACKGROUND OF THE DISCLOSED TECHNOLOGY

The present invention is directed toward a novelty lamp and, more particularly, to such a device which includes a container containing two substances of differing relative densities, wherein the application of heat to the bottom of the container causes the substance with the initially greater relative density to rise in the other substance and flow around the container to provide an aesthetically pleasing visual effect.

Ferro fluid displays are well known in the art. An example of one such device is described in U.S. Pat. No. 3,648,269 to Rosenweig. Such ferro fluid displays typically comprise a container, which holds a ferro fluid and another immiscible liquid substance. The ferro fluid is responsive to a magnetic field and can be manipulated by controlling the magnetic field to create different patterns.

Novelty lamps of the type commonly referred to as "lava lamps" are well known in the art. An example of one such device is described in U.S. Pat. No. 3,387,396 to Smith. Such novelty lamps typically comprise a container which holds a paraffin based substance and a liquid substance. A heating element situated adjacent the bottom surface of the container heats the paraffin based substance causing the same to become flowable. The heating element is typically in the form of a light bulb so that the container and its contents can be illuminated.

When the paraffin-based substance is sufficiently heated by the light bulb, globules are formed which are less dense than the liquid and therefore rise and circulate within the container. As the globules approach the top surface of the container they cool, become denser and fall back toward the bottom surface. After the light bulb is turned off, the globules once again form one uniform mass which settles adjacent the bottom surface of the container.

The paraffin-based substance is solid at room temperature and requires a phase transfer to liquid by the addition of heat for several hours.

Over the years, no significant changes have been made to the substances inside the container of such novelty lamps to make said substances responsive to a magnetic field. Additionally, no significant changes have been made to the substances inside the container of such novelty lamps to increase said substances ability to flow more quickly and efficiently. Accordingly, it is the main object of the present invention to provide a novelty lamp of the type described above with the added ability of being comprised a substance that is responsive to a magnetic field and begins to flow in minutes, rather than hours, while consuming less energy.

All references cited herein are incorporated herein by reference in their entireties.

BRIEF SUMMARY OF THE INVENTION

In accordance with the illustrative embodiments, demonstrating features and advantages of the present invention, there is provided a novelty lamp comprising a container, which is transparent or translucent in at least a portion thereof. The novelty lamp also comprises a first substance in the container and a second substance in the container. There is also a light source arranged to emit light into the container, a heat source, and a magnet.

The first substance is a liquid, and the second substance is a ferro fluid, which is immiscible with the first substance, and has a higher relative density than said first substance at 20° C. and has a lower relative density than said first substance at a higher temperature, which is higher than 20° C. The heat source is arranged to heat the first substance and the second substance in the container to the higher temperature such that the second substance forms globules which rise in the first substance toward a top surface of the container, cool, become denser and drop back down toward a bottom surface of the container. The magnet is arranged to alter the shape and a flow of the globules.

In certain embodiments, the container comprises a cylindrical glass tube. In certain embodiments, the first substance comprises water. In certain embodiments, the second substance comprises 3 to 15% by volume magnetite particles suspended in a mineral oil carrier fluid with a surfactant and has a saturation magnetization of 400 Gauss.

In another objective of the disclosed technology, in certain embodiments the light source and the heat source comprise a light bulb. Sometimes, the novelty lamp further comprises a power source arranged to selectively actuate the light bulb. Also certain embodiments have the novelty lamp having a base member in which the container, the light bulb and the power source are mounted. The magnet is moveable relative to the container in certain embodiments. The novelty lamp further comprises a circular coil positioned within the container adjacent a bottom surface thereof.

In an alternative embodiment, the container comprises a cylindrical glass tube, the first substance comprises water, the second substance comprises 3 to 15% by volume magnetite particles suspended in a mineral oil carrier fluid with a surfactant and has a saturation magnetization of 400 Gauss, the light source and the heat source comprise a light bulb, and the novelty lamp further comprises a power source arranged to selectively actuate the light bulb, and a base member in which the container, the light bulb and the power source are mounted.

Also disclosed is an illumination method, comprising: (a) providing the novelty lamp of the invention; (b) actuating the light source and the heat source to heat the second substance to the higher temperature such that the second substance forms globules which rise in the first substance toward the top surface of the container, cool, become denser and drop back down toward the bottom surface of the container; and (c) using the magnet to apply a magnetic field to the globules to alter the shape and the flow of the globules.

In certain embodiments of the method, the magnet is moved relative to the container so as to selectively alter the shape and the flow of the globules. Also in certain embodiments of the method, the novelty lamp further comprises a circular coil positioned within the container adjacent a bottom surface thereof.

In certain embodiments of the method, the container comprises a cylindrical glass tube, the first substance comprises water, the second substance comprises 3 to 15% by volume magnetite particles suspended in a mineral oil carrier fluid with a surfactant and has a saturation magnetization of 400 Gauss, the light source and the heat source comprise a light bulb, and the novelty lamp further comprises a power source arranged to selectively actuate the light bulb, and a base member in which the container, the light bulb and the power source are mounted.

Other objects, features and advantages of the invention will be readily apparent from the following detailed description of a preferred embodiment thereof taken in conjunction with the drawings.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

Figure 1:
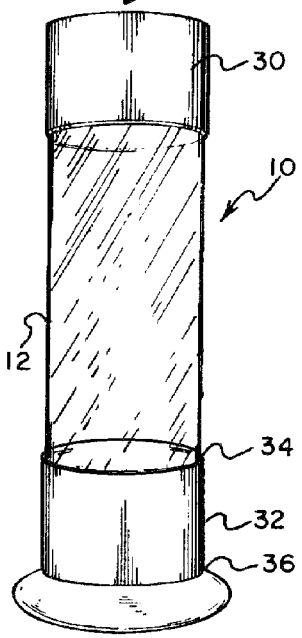
FIG. 1 is a perspective view of an embodiment of a novelty ferro fluid lamp according to the present invention.

The ensuing detailed description provides preferred exemplary embodiments only, and is not intended to limit the scope, applicability, or configuration of the disclosed technology. Rather, the ensuing detailed description of the preferred exemplary embodiments will provide those skilled in the art with an enabling description for implementing the preferred exemplary embodiments of the technology. Various changes may be made in the function and arrangement of elements without departing from the spirit and scope of the disclosed technology, as set forth in the appended claims.

Referring now to the drawings in detail wherein like reference numerals have been used throughout the various figures to designate like elements, there is shown in the figures a novelty lamp constructed in accordance with the principles of the present invention and designated generally as 10.

Figure 2:
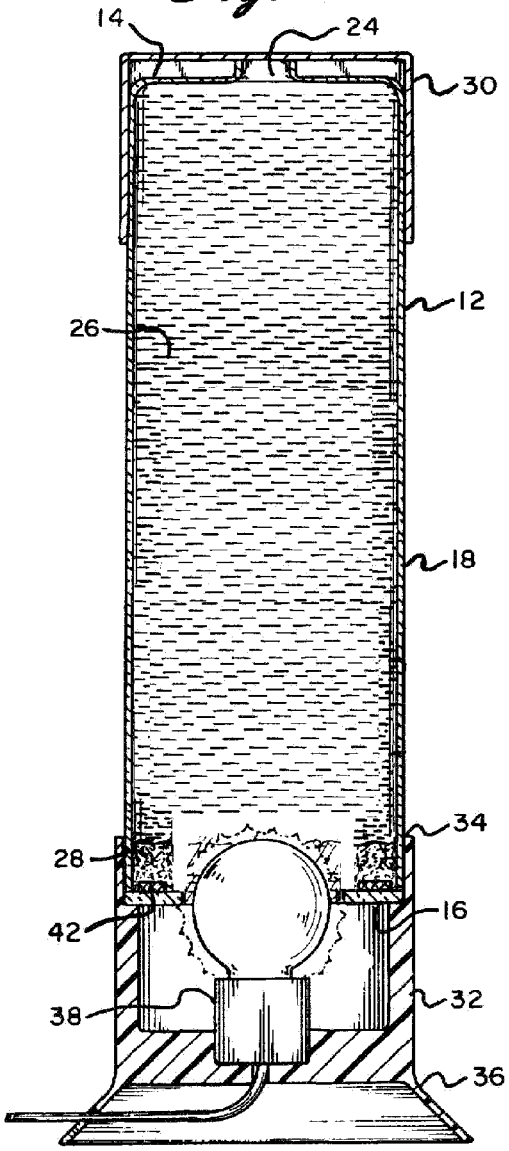
FIG. 2 is a cross-sectional view of the novelty lamp of FIG. 1.

The novelty lamp 10 includes a transparent container 12 with a top surface 14 and a bottom surface 16 (FIG. 2). The container is preferably comprised of glass, but can alternatively be constructed of any transparent or translucent material, which is sufficiently durable and chemically inert to retain the fluids therein at the temperatures generated by the lamp. Other suitable materials include but are not limited to polycarbonate, polyethylene terephthalate, polypropylene and the like.

The container 12 has an opening or fill spout 24 formed through the top surface 14 as shown in FIG. 2. A first substance 26, which is liquid at room temperature, is poured through the opening 24 until the container is filled to a desired volume, and is preferably substantially filled.

The first substance 26 is a liquid substance, which preferably comprises water, but in alternative embodiments can be other liquids, which are preferably non-flammable, non-toxic and are in the liquid state from 10 to 50° C.

A dye or other colorant can optionally be added to the first substance 26 to provide an aesthetically pleasing color. Suitable dyes and colorants are not particularly limited, but are preferably soluble in the first substance, do not react with the container or the other contents thereof, and are light stable and thermally stable. Non-limiting examples of suitable dyes and colorants include food colorants, such as pigments or water-soluble dyes (e.g., FD&C colors or lakes).

A second substance 28 is also inserted through the opening 24 in the top surface 14 of the container 12. The second substance is a ferro fluid, which is immiscible with the first substance, has a higher relative density than the first substance at room temperature (i.e., 20° C.) and has a lower relative density than the first substance at higher temperatures, such as e.g., at temperatures above 30° C., above 40° C., above 45° C., or above 50° C.

In the preferred embodiment, the second substance is comprised of a ferro fluid that can be manipulated with a magnet to create different patterns as described in U.S. Pat. No. 3,648,269 to Rosenweig. The two substances should be of contrasting color so that they can be readily visually distinguishable from one another. Contrasting color could be different shades of one color or different colors altogether. Suitable ferro fluids include but are not limited to hydrocarbon based ferro fluids, fluorocarbon based ferro fluids, and water based ferro fluids. Particularly preferred is EFH1 ferro fluid manufactured by Ferrotec Corp., which comprises 3 to 15% by volume magnetite particles suspended in a mineral oil carrier fluid with a surfactant and has a saturation magnetization of 400 Gauss. Ferro fluids disclosed in U.S. Pat. No. 6,056,889 and the publications referenced therein are also suitable for use in certain embodiments of the present invention.

Figure 3:
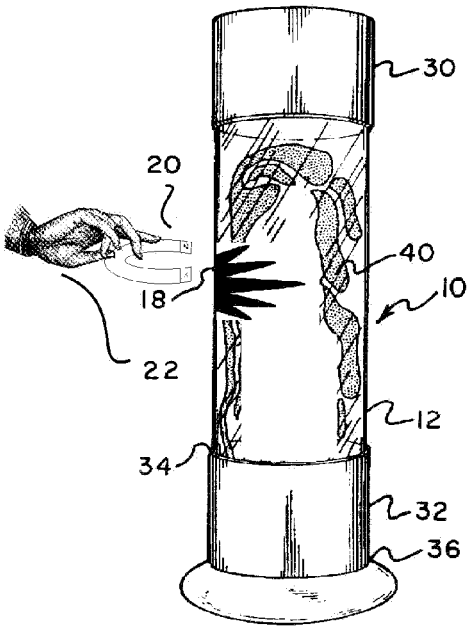
FIG. 3 is a perspective view of an embodiment of the inventive novelty lamp, which shows heated globules rising, cooling and falling therein, and also shows globules being manipulated with a magnet to form a spiking pattern.

The ferro fluid is liquid at room temperature and has a surface tension, which prevents the same from sticking to the walls of the container. The ferro fluid forms spikes 18 when an external magnet 20 is placed nearby and is attracted to the magnet as best illustrated in FIG. 3. The magnet 20 can be held by hand 22, but may also be positioned by an adequate mechanical system. Additionally, at room temperature, the ferro fluid settles on the bottom surface 16 of the container 12 as one uniform mass as best illustrated in FIG. 2.

Once the contents of the container have been received therein, the opening 24 in the top surface of the container is sealed by a cap 30, which is secured over the same. In the preferred embodiment, the cap 30 is friction fit over the top surface 14 of the container. However, the opening 24 can be sealed in a variety of other ways. For example, a stopper can be friction fit directly in the opening 24. In other embodiments, bonding the cap or stopper to the container with an adhesive permanently seals the container.

The novelty lamp 10 further includes a substantially hollow base member 32 with an open upper end 34 (FIG. 2) and a lower end 36. The bottom surface 16 of the container 12 is mounted in the base member 32. Extending upwardly from the lower end 36 of the base member 32 is a heating means (or heat source) 38. The heating means is preferably also a lighting means (or light source) in the form of an electric light bulb which heats the second substance 28 located adjacent the bottom surface 16 of the container 12. The light bulb also serves to illuminate the container 12 and the contents thereof in order to provide a pleasing visually perceptible appearance.

As the second substance 28 is heated to a suitable temperature, typically between 45 and 50° C., it becomes flowable about the liquid substance 26 of the container 12. Globules 40 of the second substance 28 are also formed as the second substance 28 is heated (FIG. 3). Furthermore, the second substance 28 becomes less dense. When the relative density of the globules falls below the relative density of the liquid substance 26, the globules 40 rise and circulate in the container. As the globules approach the top surface 14 of the container 12, they begin to cool and become denser.

When the relative density of each of the globules becomes greater than the relative density of the liquid substance 26, the globules 40 fall back down toward the bottom surface 16 of the container 12 where they re-unite with other globules, which have already descended. The second substance 28 is responsive to a magnetic field and can be manipulated into different patterns by controlling the magnetic field. Additionally, the second substance 28 begins to flow within minutes. In preferred embodiments, the second substance 28 forms rising globules in the container within 60 minutes or 45 minutes or 30 minutes or 20 minutes or 10 minutes of 5 minutes of activating heating means 38.

In the preferred embodiment, a circular coil is positioned around the inner portion of the container 12 adjacent the bottom surface 16 thereof. The circular coil 42 is heated by the light bulb and provides uniform heat around the bottom surface 16 of the container 12 in order to ensure that relatively large and homogeneous globules are formed (FIG. 2). The circular coil also causes descending globules to readily rejoin with other globules, which have already descended. The circular coil preferably comprises any material of low magnetic permeability and having a shape effective to break the surface tension of the globules while withstanding the heat from the heating source. Most preferably 316 stainless steel.

It is recognized by those skilled in the art that changes may be made to the above-described embodiments of the disclosed technology without departing from the spirit or essential attributes thereof. It is understood; therefore, that this technology is not limited to the particular embodiments disclosed but is intended to cover all modifications which are in the spirit and scope of the disclosed technology.

What is claimed is:

1. A novelty lamp comprising:

a container which is transparent or translucent in at least a portion thereof;

a first substance in the container;

a second substance in the container;

a light source arranged to emit light into the container;

a heat source; and a magnet, wherein: (a) the first substance is a liquid, (b) the second substance is a ferro fluid which is immiscible with the first substance, has a higher relative density than said first substance at 20° C. and has a lower relative density than said first substance at a higher temperature which is higher than 20° C.; (c) the heat source is arranged to heat the first substance and the second substance in the container to the higher temperature such that the second substance forms globules which rise in the first substance toward a top surface of the container, cool, become denser and drop back down toward a bottom surface of the container; and (d) the magnet is arranged to alter a shape and a flow of the globules.

2. The novelty lamp of claim 1, wherein the container comprises a cylindrical glass tube.

3. The novelty lamp of claim 1, wherein the first substance comprises water.

4. The novelty lamp of claim 1, wherein the second substance comprises 3 to 15% by volume magnetite particles suspended in a mineral oil carrier fluid with a surfactant and has a saturation magnetization of 400 Gauss.

5. The novelty lamp of claim 1, wherein the light source and the heat source comprise a light bulb.

6. The novelty lamp of claim 5, further comprising a power source arranged to selectively actuate the light bulb.

7. The novelty lamp of claim 6, further comprising a base member in which the container, the light bulb and the power source are mounted.

8. The novelty lamp of claim 1, wherein the magnet is moveable relative to the container.

9. The novelty lamp of claim 1, further comprising a circular coil positioned within the container adjacent a bottom surface thereof.

10. The novelty lamp of claim 1, wherein the container comprises a cylindrical glass tube, the first substance comprises water, the second substance comprises 3 to 15% by volume magnetite particles suspended in a mineral oil carrier fluid with a surfactant and has a saturation magnetization of 400 Gauss, the light source and the heat source comprise a light bulb, and the novelty lamp further comprises a power source arranged to selectively actuate the light bulb, and a base member in which the container, the light bulb and the power source are mounted.

11. An illumination method, comprising:

providing the novelty lamp of claim 1;

actuating the light source and the heat source to heat the second substance to the higher temperature such that the second substance forms globules which rise in the first substance toward the top surface of the container, cool, become denser and drop back down toward the bottom surface of the container; and using the magnet to apply a magnetic field to the globules to alter the shape and the flow of the globules.

12. The method of claim 11, wherein the container comprises a cylindrical glass tube.

13. The method of claim 11, wherein the first substance comprises water.

14. The method of claim 11, wherein the second substance comprises 3 to 15% by volume magnetite particles suspended in a mineral oil carrier fluid with a surfactant and has a saturation magnetization of 400 Gauss.

15. The method of claim 11, wherein the light source and the heat source comprise a light bulb.

16. The method of claim 15, wherein the novelty lamp further comprises a power source arranged to selectively actuate the light bulb.

17. The method of claim 16, wherein the novelty lamp further comprises a base member in which the container, the light bulb and the power source are mounted.

18. The method of claim 11, wherein the magnet is moved relative to the container so as to selectively alter the shape and the flow of the globules.

19. The method of claim 11, wherein the novelty lamp further comprises a circular coil positioned within the container adjacent a bottom surface thereof.

20. The method of claim 11, wherein the container comprises a cylindrical glass tube, the first substance comprises water, the second substance comprises 3 to 15% by volume magnetite particles suspended in a mineral oil carrier fluid with a surfactant and has a saturation magnetization of 400 Gauss, the light source and the heat source comprise a light bulb, and the novelty lamp further comprises a power source arranged to selectively actuate the light bulb, and a base member in which the container, the light bulb and the power source are mounted.

* * * * *